US005166652A

United States Patent [19]

Koyama et al.

[11] Patent Number: 5,166,652

[45] Date of Patent: Nov. 24, 1992

[54] BISTABLE SOLENOID FOR USE WITH A KNITTING MACHINE

[75] Inventors: Yoshiteru Koyama; Hiroyuki Ueyama, both of Wakayama, Japan

[73] Assignee: Shima Seiki Mfg., Ltd., Wakayama, Japan

[21] Appl. No.: 717,586

[22] Filed: Jun. 19, 1991

[30] Foreign Application Priority Data

Jun. 29, 1990 [JP] Japan ..... 2-172900

[51] Int. Cl.[5] ..... H01F 7/08

[52] U.S. Cl. ..... 335/234; 335/229; 335/266

[58] Field of Search ..... 335/229, 230, 234, 256, 335/266, 78, 79, 80, 81, 84, 85

[56] References Cited

U.S. PATENT DOCUMENTS 3,070,730 12/1962 Gray et al. ..... 335/229
3,202,886 8/1965 Kramer ..... 335/234
4,422,060 12/1983 Matsumoto et al. ..... 335/256
4,774,485 9/1988 Dietrich ..... 335/230

*Primary Examiner*—Harold Broome
*Attorney, Agent, or Firm*—Edwin E. Greigg; Ronald E. Greigg

[57] ABSTRACT

A bistable solenoid for use with a knitting machine. The bistable solenoid includes an enclosure made of magnetic material which includes bearing surfaces at opposite ends. A plunger having a central region made of magnetic material and outer end regions made of non-magnetic material is movable within the enclosure for operation of a cam of a knitting machine. The movable plunger is controlled by axially aligned permanent magnets which are spaced from each other by a yoke. The permanent magnets are sandwiched between magnetizable coils which move the plunger toward the coil that is excited. The plunger is spaced radially from the coil's magnets and bearing so that very little wear is brought about during use in operating the cam of the knitting machine.

3 Claims, 7 Drawing Sheets

BISTABLE SOLENOID FOR USE WITH A KNITTING MACHINE

BACKGROUND OF THE INVENTION

The present invention relates to a solenoid including permanent magnets arranged for bistable actuation in combination with a knitting machine employing the same.

A known bistable solenoid is provided with a yoke having two permanent magnets arranged on opposite sides of a magnetizing coil and a movable ferrous core which has an overall length shorter than the distance between the outer ends of their respective permanent magnets and is movably fitted into the yoke, as disclosed in Japanese Patent Laid-open publication 56-26127 (1981) or Utility-model Laid-open Publication 54-35314 (1979).

A disadvantage is that an accurate positioning of the movable ferrous core at a desired position is troublesome.

For the purpose of eliminating a disadvantage, a modification has been proposed as shown in Japanese Utility-model Laid-open Publication 63-188910 (1988).

As best shown in FIG. 6, the modification comprises a solenoid enclosure P11, a couple of magnetizing coils P13 and P14 sandwiching therebetween a permanent magnet P12 which is magnetized in radial polarity orientation, two end plates P15 and P16 arranged on the outer sides of the two magnetizing coils P13 and P14 respectively, and a cylindrical sleeve P17 extending outward across the two end plates P15 and P16. Accordingly, there are developed a pair of left and right magnetic coils P13 and P14 between the center permanent magnet P12 and the two end plates P15 and P16, respectively. The cylindrical sleeve P17 accommodates a movable iron core P18 which extends lengthwise of the sleeve P17 and has two interacting regions P19 and P20 arranged equal in width to their respective end plates P15 and P16. Also, a couple of small-diameter regions P21 and P22 of the movable iron core P18 are formed inside their respective interacting regions P19 and P20.

Since the small-diameter regions P21 and P22 of the movable iron core P18 are smaller in permeability than the other regions, the movable iron core P18 becomes stable when either of its interacting regions P19 and P20 meets the corresponding end plate P15 or P16. Also, the thickness of the end plate P15 or P16 is identical to the width of the interacting region P19 or P20 so that the positioning of the movable iron core P18 can be ensured.

A cam drive mechanism of a knitting machine using such a known solenoid is illustrated in FIG. 7. The solenoid P2 is fixedly mounted by a retaining member P3 to a base plate P1. A movable plunger P6 of the solenoid P2 is provided for pressing upward one end of a rocking lever P5 pivotably supported by a support P4. The other end of the rocking lever P5 is arranged for actuating a lift-down cam P7 or the like. When the solenoid P2 is deenergized, its moving plunger P6 remains retracted by means of a spring.

Also, disclosed in Japanese Patent Laid-open Publication 57-29649 (1982) is a cam supporting carriage of a knitting machine which carries a movable cam actuated by an electromagnetic positioning means for outward and inward movement to control the action of knitting needles. The electromagnet positioning means comprises a permanent magnet exhibiting a small magnetic field and arranged in combination with coils for magnetization and demagnetization and a moving unit of ferromagnetic metal material linked to the cam to be positioned. Also, a magnetization control circuit is provided for allowing the coils to perform a magnetizing and demagnetizing action on the permanent magnet using current pulses. As a result, both the moving unit and the movable cam linked with the moving unit can be actuated by the action of magnetic attraction and repulsion for cam engagement and disengagement.

However, the foregoing solenoid described in Japanese Utility-model Laid-open Publication 63-188190 still has a drawback that the movable iron core slides directly on the inner surface of the cylindrical sleeve and thus, both will unavoidably be worn away. Particularly, the movable iron core is made of soft iron for enhancement of magnetic characteristics having a low resistance to wear.

The magnetic circuit extends up to the end plates where there are slight clearances between the cylindrical sleeve and the interacting regions of the movable iron core. Hence, the magnetic flux tends to leak out and attract unwanted materials, e.g., existing iron dust. Such iron dust may enter inside the sleeve and accelerate the wear of both the movable iron core and the cylindrical sleeve.

The clearance between the cylindrical sleeve and the interacting regions of the movable iron core has to be determined to a minimum distance for minimizing the entrance of iron dust and the end plates are not allowed to act as bearing bushes.

Also, if the magnetic intensity of the permanent magnet is increased for increasing a force of retention, a greater energy of flux develops across the magnetic circuit. Simultaneously, the magnetic circuit causing unstable conditions is also increased in the magnetic energy. As a result, the permanent magnet and/or the magnetizing coils have to be increased in size for producing appropriate rates of retention force and thrust force while the moving distance of the movable iron core has been set to a desired length.

The foregoing known knitting machine employs a multiplicity of such solenoids which produce a thrust of 1 kgf for actuating each lift-down cam which can be driven by a thrust as small as 300 gf.

The 1-kgf solenoid produces not only a greater thrust but also an unwanted physical impact causing noise and vibration during operation of the knitting machine and the operational durability will be declined. The size of the solenoid has to be increased proportional to the magnitude of a thrust and will never contribute to the compactness of the knitting machine.

Furthermore, the foregoing solenoid used for actuating the cam in a knitting machine, as shown in FIG. 7, has to be accompanied with the rocking lever P5 for cam actuation, the retaining member P3, the support P4. etc. Accordingly, the cam drive arrangement is complicated and hardly decreased in size. Also, the mass of inertia of moving parts becomes great, thus discouraging high-speed operation and requiring large magnetizing power.

In addition, the adjustment on the clearance at the stress and action points of the lever P7 has to be carefully carried out, which is troublesome.

The solenoid of the cam supporting carriage disclosed in Japanese Patent Laid-open Publication 57-29649 contains a single permanent magnet and is thus provided with a spring which produces a counter-force for bistable movement. For drawing the iron core, a greater force of magnetic attraction is needed than the yielding force of the spring. This results in declination in the efficiency of energy conversion. Also, during returning of the cam to its actuating position, the iron core is abruptly pressed outward by the yielding force of the spring, thus producing a physical shock which may accelerate the wear of the iron core and its relevant components.

It is then an objection of the present invention to provide an improved bistable solenoid and a knitting machine using the same.

SUMMARY OF THE INVENTION

A bistable solenoid according to the present invention, which has an outer enclosure made of magnetic material, a movable plunger comprising two end regions made of non-magnetic material and a central region made of magnetic material. The movable plunger is arranged to extend inside and axially lengthwise of the outer enclosure. A pair of plunger bearings provided on the outer enclosure supports the two non-magnetic end regions of the movable plunger during a sliding movement within the outer enclosure. The bistable solenoid is further provided with a couple of axially aligned permanent magnets arranged a given distance apart around the movable plunger so that their magnetic lines of force are opposite to each other and includes a couple of magnetizing coils which sandwich the two permanent magnets therebetween. Each of the plunger bearings is arranged to have a thickness greater than the given distance between the permanent magnets. The movable plunger has a low permeability recess formed in a portion of the central region thereof where the magnetic permeability is smaller than in the other regions. The central region of the movable plunger which is made of magnetic material is arranged to have a length equal to the sum of the distance between the inner walls of the two plunger bearings including the given distance between the two permanent magnets. The inner sides of the permanent magnets and magnetizing coils are spaced a small distance from the movable plunger.

Also, a knitting machine according to the present invention employs the foregoing bistable solenoid for cam drive action of a carriage. In particular, the solenoid is fixedly mounted to a base plate of the carriage by a retaining member provided on the outer enclosure thereof and its movable plunger is coupled directly to a cam so that the cam can be actuated by the forward and backward movement of the solenoid.

More specifically, the solenoid of the present invention comprises a couple of permanent magnets arranged in axial alignment and spaced apart by a yoke so that their magnetic directions are opposite to each other, two magnetizing coils are arranged outside the permanent magnets respectively, a cylindrical sleeve of magnetic material extends across the permanent magnets and the magnetizing coils and a pair of plunger bearings of magnetic material are provided outwardly of the permanent magnets.

The cylindrical sleeve accommodates a movable iron core which can slide inside the cylindrical sleeve free of a contact relationship while being supported by the two bearings. The movable iron core has a high permeability region and a low permeability region arranged corresponding to the distance between the two permanent magnets. More particularly, a portion of the movable plunger of magnetic material having a high permeability is recessed to have a space filled with air having a low permeability thus constituting a low permeability region.

In operation, if the low permeability region is displaced off both the permanent magnets, the nearest one (for example, the right magnet) of the two permanent magnets attracts the low permeability region to move rightward for stable positioning. While the low permeability region of the movable iron core remains engaged with the permanent magnet having the same width magnetic lines of flux extend from one of the two poles of the axially aligned permanent magnet across a high permeability region, located beside the low permeability region, and the other high permeability region of the iron core to the other pole of the permanent magnet, forming a magnetic circuit. Hence, if the movable iron core is displaced from its stable position, a force of magnetic attraction is activated to return it to the stable position.

Accordingly, the magnetically stable condition can be maintained.

When the magnetizing coil is energized for producing magnetic flux, a force of attraction is developed between the left end of the high permeability region and the inner side of the yoke causing the movable iron core to move leftward, because the plunger journal is formed of nonmagnetic material. After moving leftward, the movable iron core stops at a position where its low permeability region comes opposite to the permanent magnet and remains in a stable state.

This stable state can be maintained by offsetting a displacement, if caused, with the use of an attracting force of the permanent magnet.

When the magnetizing coil is energized, a force of attraction is developed between the inner side of the right yoke and the right end of the high permeability region. Hence the movable iron core is moved rightward and then, remains at a position where its low permeability region comes opposite to the permanent magnet forming a stable state.

This stable state can be maintained by offsetting a displacement, if caused, with the use of an attracting force of the permanent magnet.

Consequently, each of the two, left and right, stable states can be ensured.

A knitting machine according to the present invention employs the foregoing bistable solenoid for cam drive action of a carriage so that each cam can be actuated by the bistable movement of the solenoid.

Also, the solenoid is fixedly mounted to a base plate of the carriage by a retaining member provided on its outer enclosure thus easing its positioning.

Furthermore, the movable iron core or plunger of the solenoid is coupled directly to the cam and thus, no link mechanism, e.g. a rocking lever, is needed.

DESCRIPTION OF THE PREFERRED EMBODIMENT

A bistable solenoid of an embodiment of the present invention will be described in more detail referring to the accompanying drawings.

Figure 1:
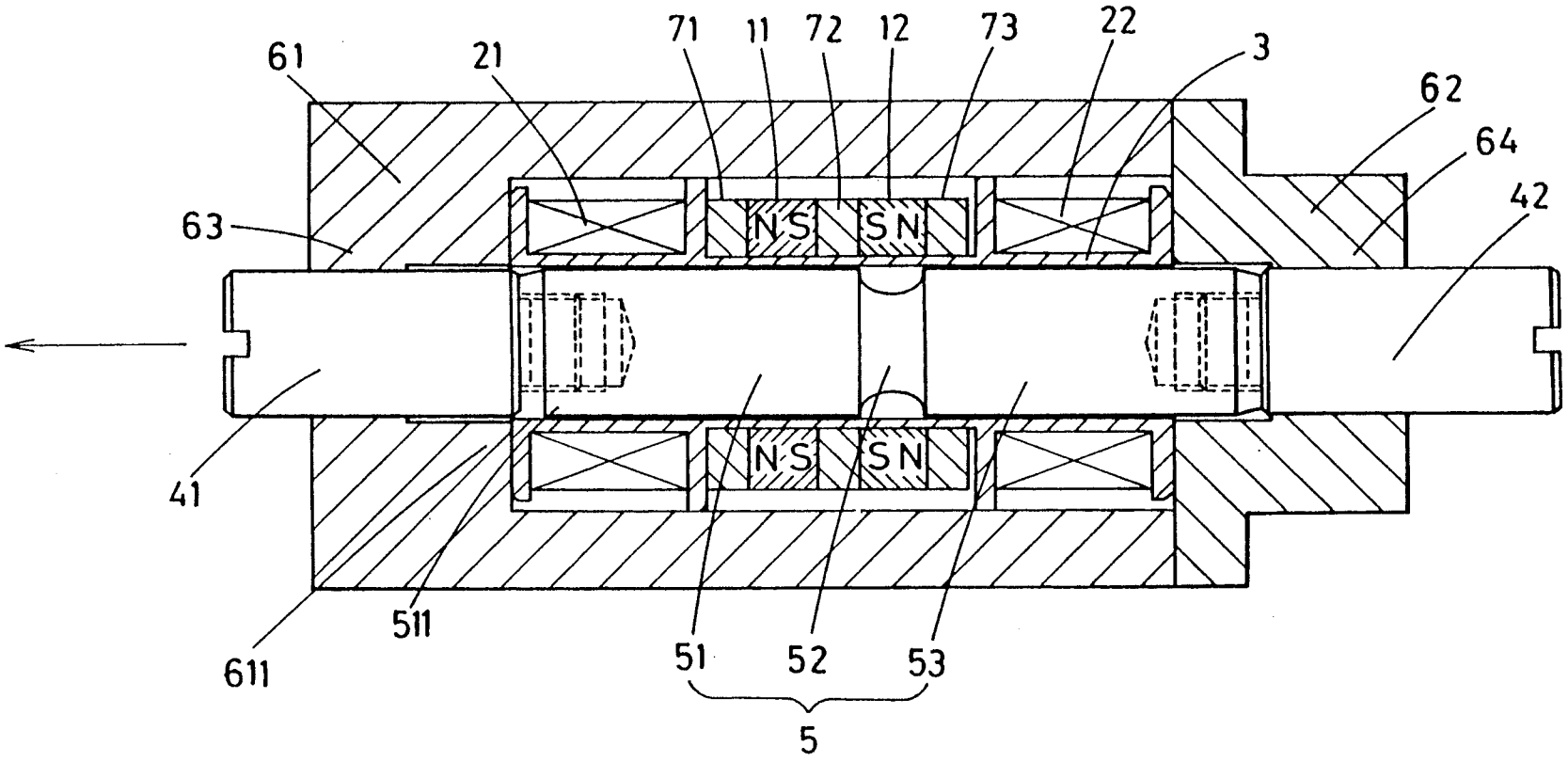
FIGS. 1 and 2 are cross sectional plan views of a bistable solenoid showing one embodiment of the present invention.
Figure 2:
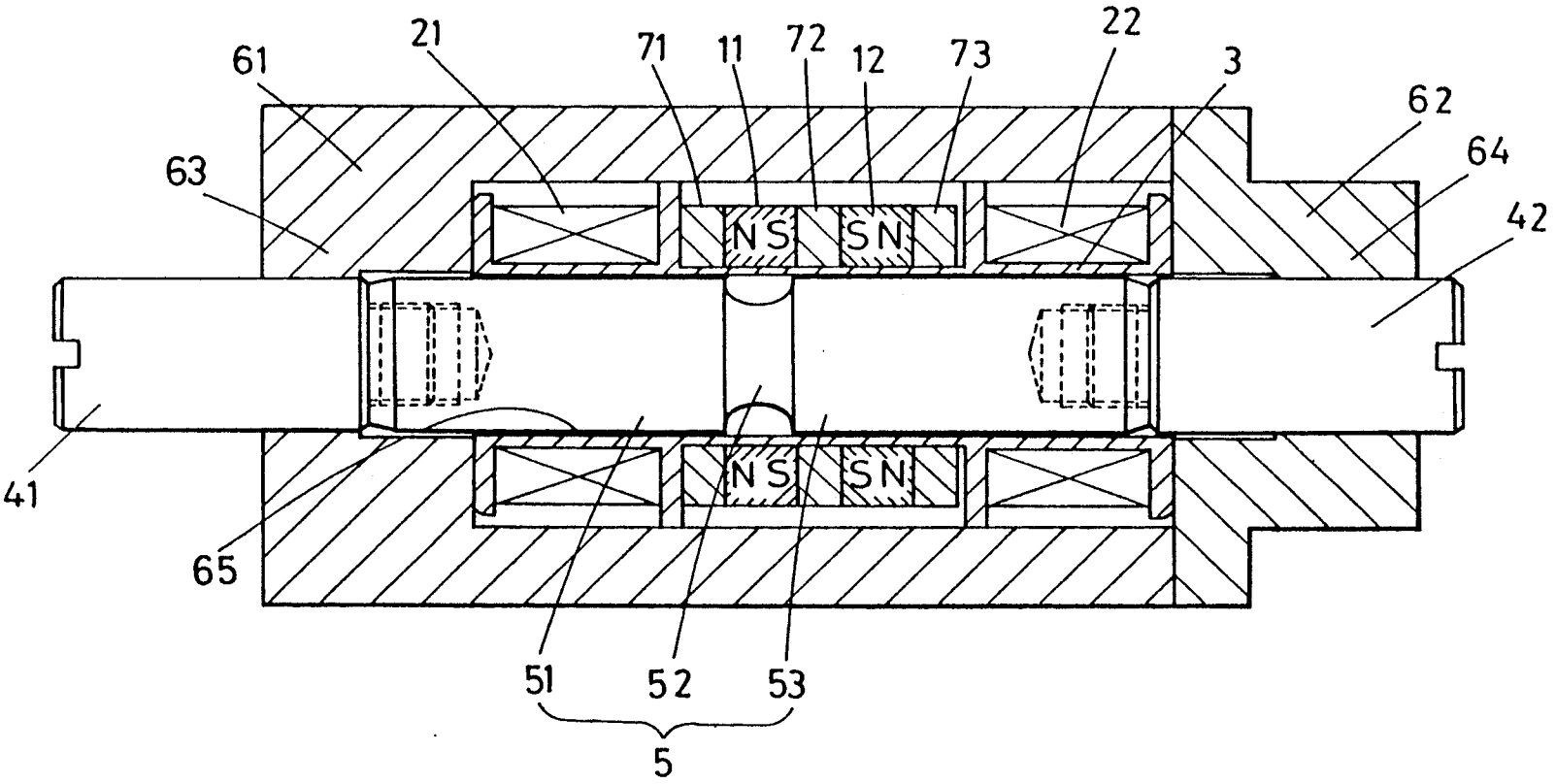
Figure 3:
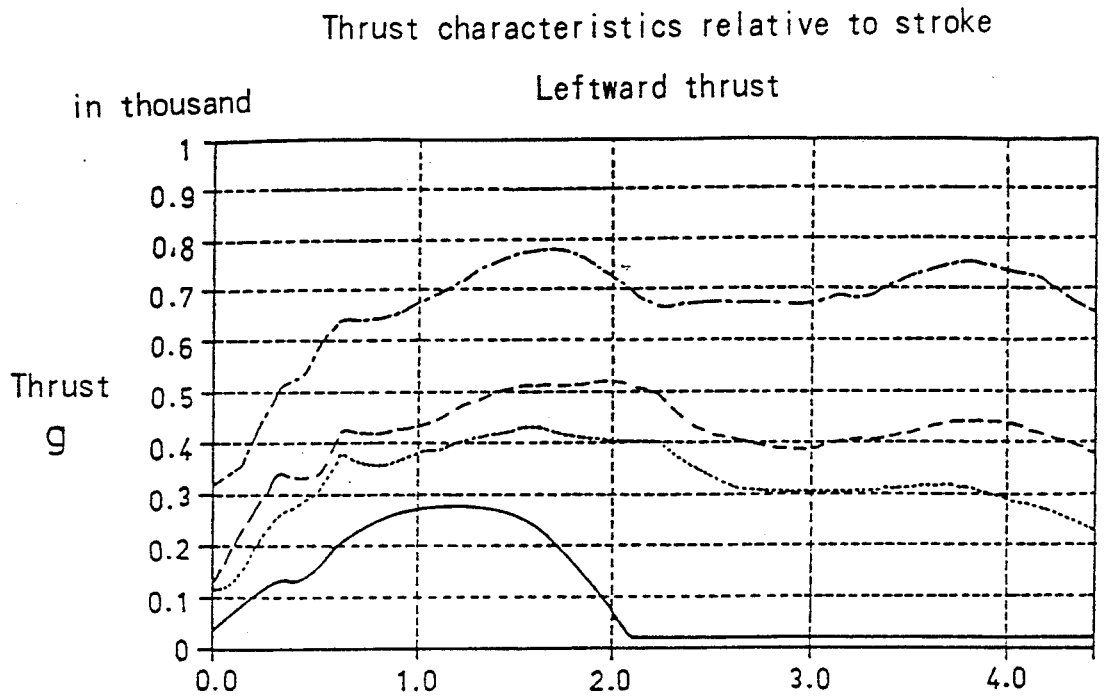
FIG. 3 is a thrust characteristic diagram of the bistable solenoid.
Figure 3:
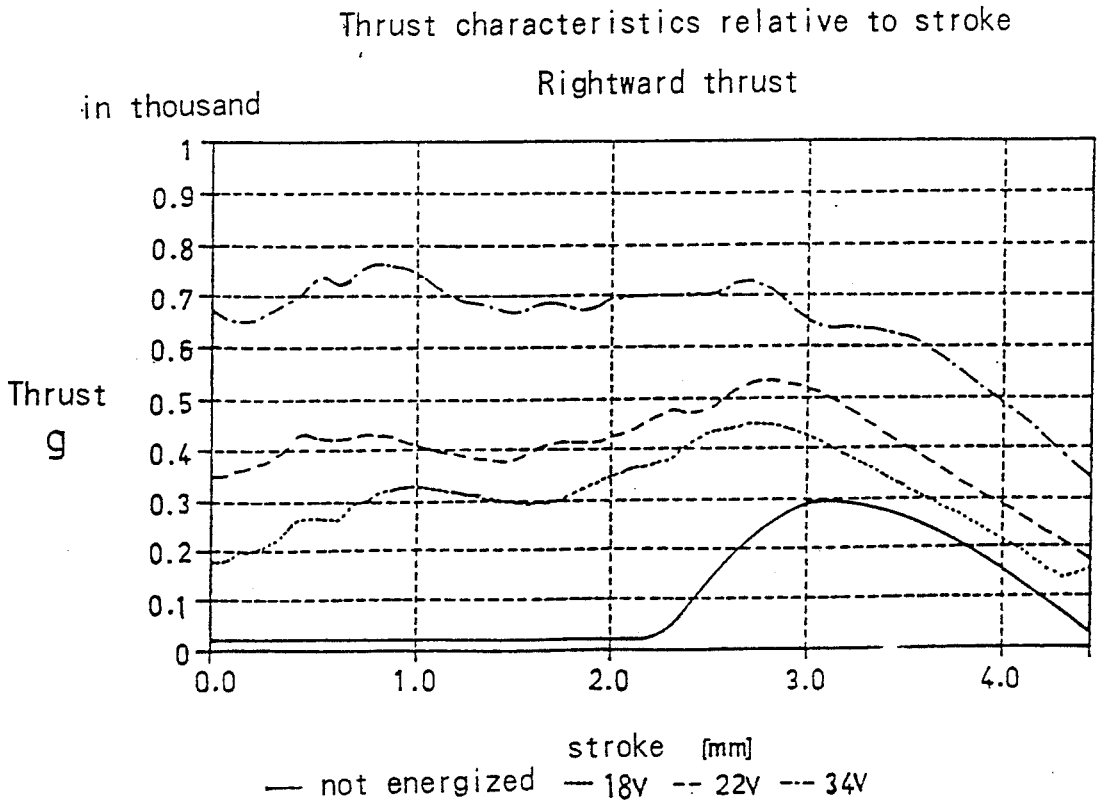

FIG. 1 and 2 are cross sectional views of the bistable solenoid of the present invention and FIG. 3 is a thrust force characteristic diagram of the same.

As shown, the bistable solenoid of the present invention incorporates an enclosure, a couple of spaced axially aligned permanent magnets 11 and 12 arranged so that their magnetic directions are opposite to each other. The two permanent magnets 11 and 12 have an inner yoke 72 interposed therebetween and two other yokes 71 and 73 arranged on their respective outer sides. There are also provided two magnetizing coils 21 and 22 on the outer sides of the yokes 71 and 73, respectively. The foregoing assembly is mounted within the enclosure onto a cylindrical sleeve 3 so that the cylindrical sleeve 3 extends inside and lengthwise of the assembly. The cylindrical sleeve 3 is then interposed between two yokes 61 and 62 of the magnetic material which are a part of the enclosure and have bearing portions 63 and 64, respectively.

The cylindrical sleeve 3 accommodates an axially movable ferrous core 5 which has an outer diameter slightly smaller than the inner diameter of the cylindrical sleeve 3 so that the core 5 can slide along the inside of the cylindrical sleeve 3 without touching the surface of the sleeve. The movable ferrous core 5 has a recess in the central portion thereof which is equal in the width to the permanent magnets 11 and 12 and serves as a small-diameter interacting region 52 that exhibits a higher permeability. Hence, two large-diameter interacting regions 51 and 53 of the movable ferrous core 5 are formed on opposite sides axially of the small-diameter interacting region 52. The large-diameter interacting regions 51 and 53 are coupled at their outer ends to two plunger journals 41 and 42 of non-magnetic material, respectively. the plunger journals 41 and 42 are arranged for slide movement along their respective bearing portions 63 and 64 of the yokes.

In operation, if the small-diameter interacting region 52 is displaced off both the permanent magnets 11 and 12, the nearest one (for example, the right magnet 12) of the two permanent magnets 11 and 12 attracts the small-diameter interacting region 52 for stable positioning. While the small-diameter interacting region 52 of the movable ferrous core 5 remains engaged with the permanent magnet 12 having the same width, magnetic lines of flux extend from one of the two poles of the axially aligned permanent magnet 12 across the large-diameter interacting regions 53 and 51, beside the small-diameter interacting region 52, of the ferrous core 5 to the other pole of the permanent magnet 11, forming a magnetic circuit. Hence, if the movable ferrous core 5 is displaced from its stable position, the magnetic attraction acts as a restoring force to return it to the stable position.

Accordingly, the magnetically stable condition can be maintained.

When the magnetizing coil 21 is energized for producing magnetic flux, a force of attraction is developed between the inner side of the yoke 71 and the left end of the large-diameter interacting region 51 causing the movable ferrous core 5 to move leftward, because the plunger journal 41 is formed of non-magnetic material. After moving leftward, the movable ferrous core 5 stops at a position where its small-diameter interacting region 52 is positioned opposite to the permanent magnet 11 and remains in a stable state (See FIG. 2).

This stable state can be maintained when the magnetizing coil 21 is deenergized. More particularly, the attraction of the permanent magnet 11 acts as a restoring force and allows the removable ferrous core 5 to be returned to its stable position, if displaced.

Also, when the magnetizing coil 22 is energized, a force of attraction is developed between the inner side of the right yoke 72 and the right end of the large-diameter interacting region 53. Hence, the movable ferrous core 5 is moved rightward and then, remains at a position where its small-diameter interacting region 52 is positioned opposite to the permanent magnet 12 forming a stable state.

This stable state is maintained when the magnetizing coil 22 is deenergized. More particularly, the attraction of the permanent magnet 12 acts as a restoring force and allows the removable ferrous core 5 to be returned to its stable position if displaced.

The restoring force acts counter to a thrust produced by the solenoid. The characteristics of the thrust are shown in FIG. 3, where 400 gf of a practical thrust and 3 mm of a stroke are produced when the magnetizing voltage is 22 volts. The thrust of such strength is eligible for use in actuating a lift-down cam of a knitting machine.

The plunger journals 41 and 42 supporting the movable ferrous core 5 are formed of non-magnetic material allowing no magnetic energy to escape to the outside. Accordingly, no collection of iron powder is caused and the bearing performance will be enhanced.

The movable ferrous core 5 can move without direct contact with the cylindrical sleeve 3, thus avoiding wear of both the materials and increasing the operational life.

The movable ferrous core 5 may be provided with a segment of low permeability material arranged in place of the small-diameter interacting region. This provides an advantage that the mechanical strength is increased with no such mechanically disadvantageous small-diameter interacting region arranged.

A knitting machine according to the present invention will be described referring to the drawings.

Figure 4:
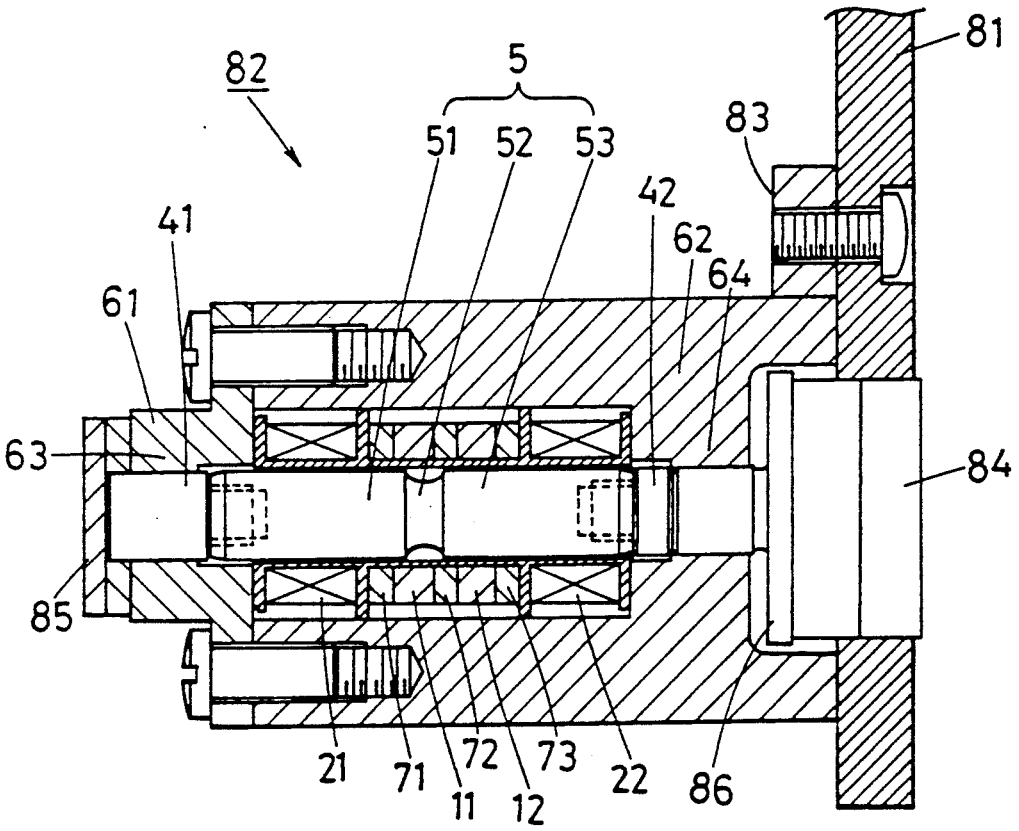
FIGS. 4 and 5 are cross sectional plan views showing a primary part of a knitting machine according to the present invention.
Figure 5:
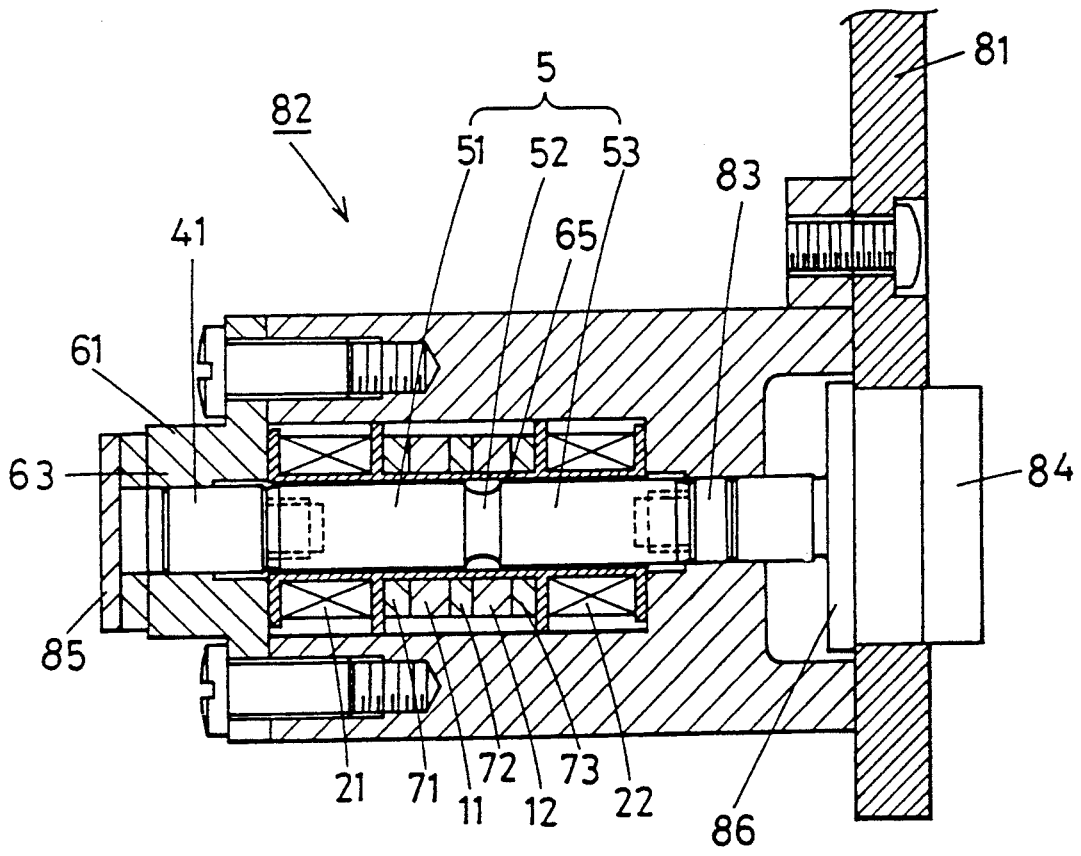
Figure 6:
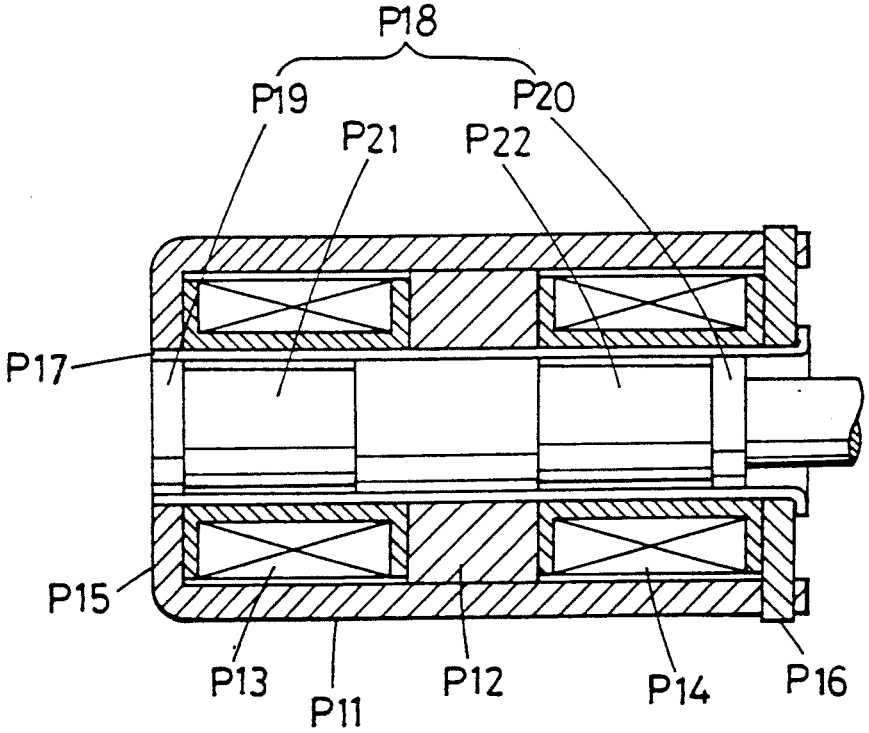
Fig. 6 PRIOR ART
FIG. 6 is a cross sectional view of a prior art bistable solenoid.
Figure 7:
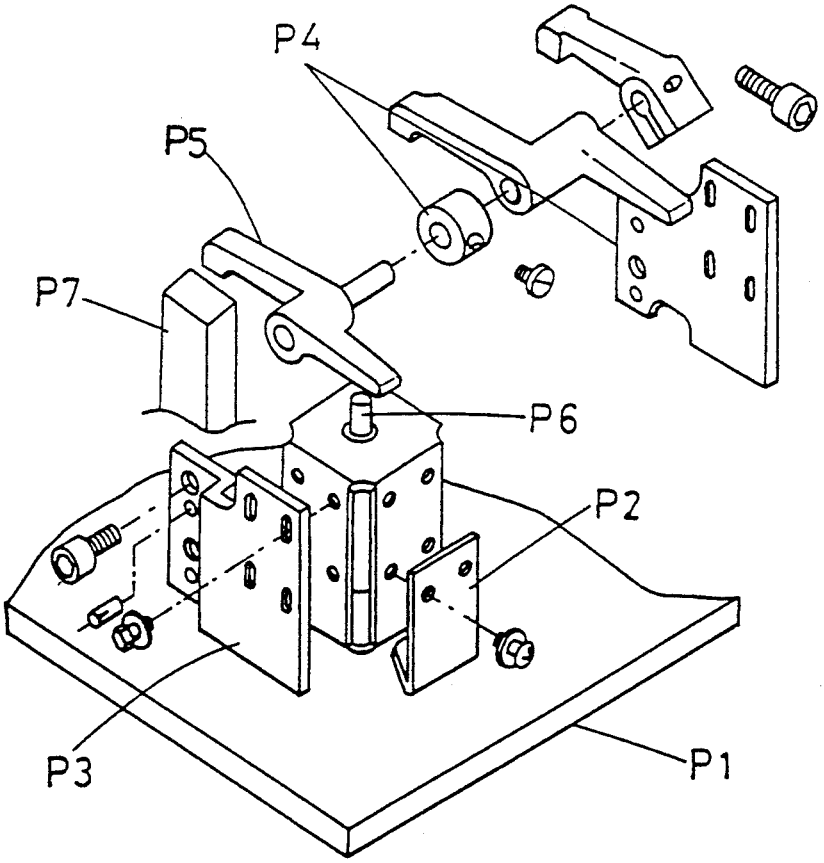
Fig. 7 PRIOR ART
FIG. 7 is an exploded perspective view showing a cam drive mechanism of the prior art knitting machine.

FIGS. 4 and 5 are cross sectional plan views showing a cam actuator section of a carriage in the knitting machine of the present invention. FIG. 4 illustrates the engagement of a cam and FIG. 5 illustrates the disengagement of the same.

As shown in FIGS. 4 and 5, there are provided a base plate 81 of the carriage, a solenoid 82 fixedly mounted by a retainer 83 to the base plate 81, the cam 84, and a stroke control stopper 85. The solenoid 82 has an interior arrangement identical to that of the foregoing bistable solenoid and will be explained with like components denoted by like numerals.

For actuating the lift-down cam in the knitting machine having such a lift-down cam mechanism, short energization of a magnetizing coil 22 produces a force of magnetic attraction between a movable plunger 5 and a yoke 62 causing the movable plunger 5 to move rightward. The movable plunger 5 then stops when a stopper 86 of the cam 84 comes into direct contact with the base plate 81. At the position, while the magnetizing coil 22 is deenergized, the small-diameter interacting region 52 of the movable plunger 5 is located a small space off the position of the right permanent magnet 12. More specifically, a thrust to draw the small-diameter interacting region 52 of the movable plunger 5 rightward is produced by the permanent magnet 12 and thus, the cam 84 remains projecting outward as resisting against a moderate force of exterior pressure caused during operation. As a result, the cam 84 allows a corresponding knitting needle to stay lifted down.

When no actuation of the lift-down cam 84 is needed, short energization of another magnetizing coil 21 produces a force of magnetic attraction between the movable plunger 5 and a left-side yoke 61 causing the movable plunger 5 to move leftward. The movable plunger 5 then stops when the left end of journal 41 come into direct contact with the stroke control stopper 85. At the stopped position, while the magnetizing coil 21 is deenergized, the small-diameter interacting region 52 of the movable plunger 5 is located a small space off the position of a left permanent magnet 11. More specifically, a thrust to draw the small-diameter interacting region 52 of the movable plunger 5 leftward is produced by the permanent magnet 11 and thus, the cam 84 remains withdrawn as resisting against a moderate rate of exterior pulling force caused during operation. As a result, the cam 84 allows its corresponding knitting needle to stay actuated.

The stroke length of the movable plunger 5 can be controlled by the two stops 85 and 86. It is a good idea that the cam 84 is arranged detachable from the bearing journal 42 for ease of maintenance. Also, it is understood that this arrangement is not limited to the lift-down cam mechanism.

The knitting machine according to the present invention employs improved solenoids arranged for bistable actuation with the use of a minimum force of decided thrust so that less physical shock is involved during the switching movement of cams. Hence, the operational reliability of the solenoids and their relevant components will be much increased.

Also, the solenoid may be mounted directly to a carriage by a mounting member arranged on its enclosure so that it directly actuates a corresponding cam in bistable movement. Accordingly, a known link mechanism, e.g. a rocking lever system, is not needed and the mass of inertia at the actuating section becomes reduced. This permits high-speed operation, low magnetizing power requirement, and energy saving.

Furthermore, no clearance adjustment is needed because each cam is directly actuated unlike the known link mechanism and thus, maintenance and servicing of the components or the machine itself will be facilitated.

As set forth above, the bistable solenoid of the present invention provides bistable actuation while preventing leakage of magnetic energy through its movable plunger to the outside of its enclosure. Hence, unwanted collection of iron powder will be avoided and high accurate, reliable cam actuating movement will be ensured.

The movable plunger or ferrous core is spaced radially a bit from each permanent magnet so that it can slide regardless of critical wear, thus providing a lifelong durability.

The knitting machine according to the present invention employs the foregoing improved solenoid arranged for bistable actuation with the use of a minimum force of desired thrust so that less physical shock is involved during the switching movement of cams. Hence, the operational reliability of the solenoids and their relevant components will be much increased.

Also, the solenoid is mounted directly to a carriage of the knitting machine so that it directly actuates a corresponding cam in bistable movement. Accordingly, a known link mechanism, e.g. a rocking lever system, is no more needed and the mass of inertia at the actuating section becomes reduced. This permits high-speed operation, low magnetizing power requirement, and energy saving.

Furthermore, no clearance adjustment is needed because each cam is directly actuated unlike the known link mechanism and thus, maintenance and servicing of the components or the machine itself will be facilitated.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A bistable solenoid having an outer enclosure made of magnetic material, a movable plunger, said movable plunger includes two end regions made of non-magnetic material and a central region made of magnetic material and arranged to extend inside and axially in a lengthwise direction of the outer enclosure, plunger bearings provided on opposite ends of the outer enclosure for supporting the non-magnetic end regions of the movable plunger during a sliding movement within said outer enclosure, the improvement comprising:

at least two permanent magnets arranged in axial alignment and spaced apart a given distance by a yoke, said at least two permanent magnets surround the movable plunger so that their magnetic directions are opposite to each other;

a couple of magnetizing coils that surround said movable plunger to sandwich the two permanent magnets therebetween;

each of said plunger bearings being arranged to have an axial thickness greater than the given distance between said at least two permanent magnets;

said movable plunger having a low permeability region in an axial mid-portion of the central region thereof where a magnetic permeability is smaller than along said central regions;

said central region of the movable plunger being arranged to have an axial length equal to the sum of the distance between the inner walls of the two plunger bearings and the given distance between the two permanent magnets; and said permanent magnets and magnetizing coils are spaced a small radial distance at inner sides thereof from the movable plunger.

2. A bistable solenoid as set forth in claim 1 which includes two further yokes on outer surfaces of said permanent magnets which surround said plunger and separate each of said permanent magnets from said magnetizing coils.

3. A bistable solenoid as defined in claim 1 for employment with a knitting machine for operating a cam for cam drive action of a carriage, in which the solenoid includes means for being fixedly mounted to a base plate of the carriage by a retaining member provided on the outer enclosure thereof and said movable plunger is coupled directly to said cam so that the cam can be actuated by a forward and backward movement of the solenoid.

* * * * *